United States Patent [19]

Becker

[11] 4,118,893

[45] Oct. 10, 1978

[54] WINDOW LIFTING MECHANISM

[75] Inventor: Herbert Becker, Coburg, Fed. Rep. of Germany

[73] Assignee: Metallwerk Max Brose & Co., Coburg, Fed. Rep. of Germany

[21] Appl. No.: 783,664

[22] Filed: Apr. 1, 1977

[30] Foreign Application Priority Data

Apr. 29, 1976 [DE] Fed. Rep. of Germany ... 7613594[U]

[51] Int. Cl.[2] ..... E05F 11/44

[52] U.S. Cl. ..... 49/348; 49/350

[58] Field of Search ..... 49/348, 350, 351, 353, 49/363; 267/156

[56] References Cited

U.S. PATENT DOCUMENTS

| | | | |
|---|---|---|---|
| 1,939,245 | 12/1933 | Ackerman et al. | 49/350 X |
| 2,114,235 | 4/1938 | Page | 49/353 |
| 2,122,661 | 7/1938 | Rightmyer | 49/351 X |
| 3,398,488 | 8/1968 | Garvey | 49/350 |
| 3,890,742 | 6/1975 | Ladd et al. | 49/350 |

*Primary Examiner*—Philip C. Kannan

*Attorney, Agent, or Firm*—Hans Berman

[57] ABSTRACT

The window in a door of an automotive vehicle is lifted by an operating lever pivotally mounted on a supporting structure in the door which includes a releasably mounted carrier member of sheet metal. The weight of the window is partly balanced by a spiral spring one of whose ends is attached to the lever. The other end is secured in a gap between two integral lugs of the carrier member which are offset at right angles from the major face of the carrier member.

8 Claims, 4 Drawing Figures

WINDOW LIFTING MECHANISM

This invention relates to window lifting mechanisms of the known type commonly employed in the doors of motorcars and other automotive vehicles in which rotation of a crank causes a window to be raised and lowered by an angularly moving operating lever, and particularly to such a window lifting mechanism in which the weight of the lifted window is partly compensated by a spring.

The springs employed in known lifting mechanisms are spiral-shaped about the axis of angular operating lever movement and so dimensioned that their turns do not touch each other during operation of the associated windows and thus do not interfere with such operation. The fastening elements which secure the ends of the known spring to an operating lever and to a supporting structure respectively are of sufficient size and weight to encumber the very limited space available for the lifting mechanism within a motorcar door, and they may contribute to an undesirable overall thickness of the door. Moreover, they require special tools and a significant amount of labor for their installation.

A primary object of this invention is the provision of a window lifting mechanism of the type described in which the spiral compensating spring is fastened to associated elements by means which neither increase the weight nor the bulk of the lifting mechanism, and which can be installed without tools or with the simplest of hand tools.

With this object and others in view, as will hereinafter become apparent, the invention provides a window lifting mechanism in which an operating member, such as a lever, is mounted on supporting structure including a carrier member for angular movement about an axis. The operating member, or preferably the carrier member, essentially consists of a unitary piece of sheet material having a face transverse to the axis of the aforementioned angular movement, and two integral lug portions of the piece are angularly offset from the face and define a gap therebetween. An elongated spiral spring extends about the axis, and a part of one of its end portions is secured in the gap between the lug portions in abutting engagement with the same. Fastening means are provided for fastening the other end portion of the spring to the operating member, if the first-mentioned end is secured to the supporting structure by the lug portions, or vice versa, in such a manner as to bias the operating member to move angularly about its axis under the resiliency of the spring.

Other features, additional objects, and many of the attendant advantages of this invention will readily be appreciated as the same becomes better understood from the following detailed description of a preferred embodiment and a modification thereof when considered in connection with the appended drawing in which.

Figure 1:
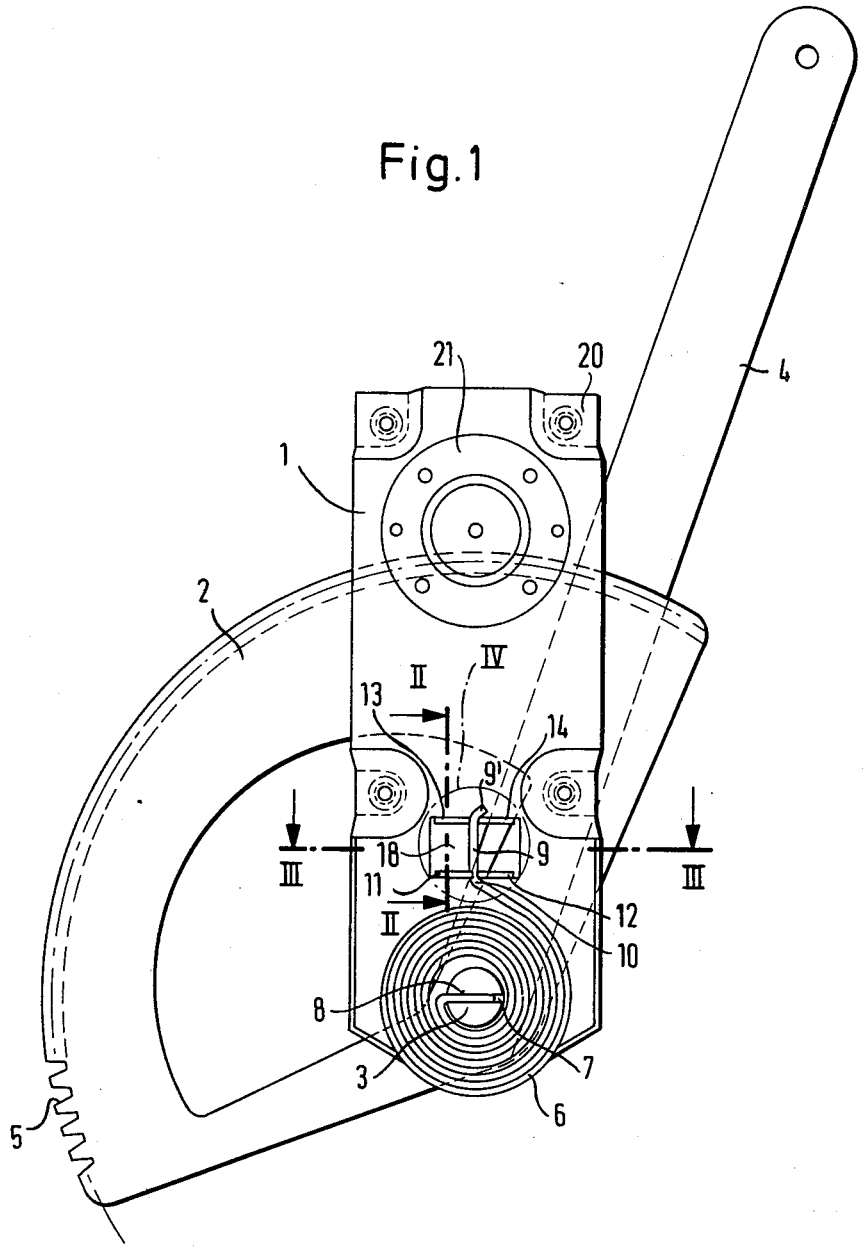
FIG. 1 shows a window lifting mechanism of the invention in fragmentary side elevation.

Referring now to the drawing in detail, and initially to FIG. 1, there is shown only as much of a window lifting mechanism in a door of a motorcar as is needed for an understanding of the invention. The supporting structure of the mechanism is represented in the drawing only by a carrier plate 1 of stamped sheet steel which is provided with four integral, apertured fastening bosses 20. Sheet metal screws in the apertures of the bosses normally attach the carrier plate to an internal, upright surface of the motorcar door. A bearing assembly 21 is rivetted to the plate 1, and a crank-operated pinion (not shown) is normally journaled in the bearing assembly.

The pinion meshes with the teeth 5 of a segment 2 rotatably mounted on the plate 1 by a short shaft 3 whose axis is perpendicular to the two major faces of the plate 1. One end of a one-armed operating lever 4 is fixedly fastened to the shaft 3 and the segment 2, and its free end is connected to the non-illustrated window to be raised and lowered by turning the non-illustrated pinion. The structure described so far is basically conventional, and its operation is too well known to require more detailed description.

The lever 4 is biased counterclockwise, as viewed in FIG. 1, by a spiral spring 6 consisting of a length of a coiled, elongated leaf of spring steel or bronze whose width is parallel to the axis of lever movement. The inner end portion 8 of the spring is received in a diametrical slot 7 of the shaft 3. The outer end portion 9 is formed with two angular bends 9′ and 10 spaced longitudinally of the spring, and parts of the end portion 9 contiguously adjacent respective bends and located between the bends 9′, 10 are received in gaps between paired lugs 11, 12 and 13, 14.

The lugs are integral portions of the sheet metal plate 1 and are formed during the same stamping operation as the fastening bosses 20, leaving an opening 18 in the body of the plate 1. As is evident from joint consideration of FIGS. 1 to 3, the lug 11 projects farther at right angle from the major face of the plate 1 than the other lugs. The major surfaces of the lugs 11, 12 are located in two common planes perpendicular to the face of the plate 1 and spacedly parallel to the corresponding common planes of the lugs 13, 14. The gap between the lugs 11, 12 receiving the part of the spring 6 near the bend 10 is bounded by parallel narrow edges 15, 16 of the lugs which connect the major surfaces. The gap between the lugs 13, 14 is similarly bounded by narrow edges of the two last-mentioned lugs.

Figure 3:
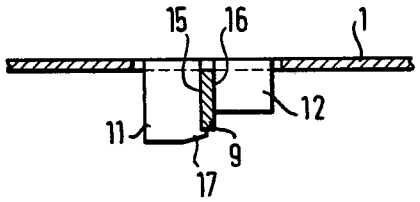

Prior to assembly of the spring 6 with the carrier plate 1, the two gaps between the rectangular, relaxed lugs 11, 12 and 13, 14 are very slightly narrower than the uniform thickness of the leaf spring material of the spring 6, but the sheet metal of the plate 1 is sufficiently resilient for the spring to be forced into the gaps, causing a deformation of the lugs too slight to permit pictorial representation on the scale of the drawing, and a much slighter resilient compression of the clampingly received parts of the spring 6. Manual pressure may be sufficient for installing the spring between the paired lugs, but a small hammer may be resorted to. The same hammer may be used for peening a corner of the lug 11 over the exposed, narrow, longitudinal edge of the spring portion 9 as is best seen in FIG. 3 at 17.

The end portion 9 of the spring 6 is thus secured longitudinally in the gaps between the lugs 11, 12, 13, 14 by the bends 9′, 10, and axially by the peened corner 17 of the lug 11. This axial hold is sufficient also to retain the spring end 8 in the axially open slot 7.

The bends 9′, 10 and the offset of the end portion 8 are formed in the spring 6 prior to final hardening. One of the bends can be avoided without loss of function in the modified device partly shown in FIG. 4 and identical with the structure illustrated in FIGS. 1 to 3 as far as not explicitly described otherwise.

The sheet metal bent out of the opening 18' during stamping of the carrier sheet 1' is formed into two pairs of lugs 11', 12' and 13, 14, the latter being identical with the correspondingly numbered elements described above. The two lugs 11', 12' are parallel, but offset longitudinally relative to the spring 6' so that their major surfaces extend in four transversely offset, substantially parallel planes, and their edges 15', 16' which bound a gap between the lugs 11', 12' face each other in a direction which is obliquely inclined relative to the four last-mentioned planes.

Figure 4:
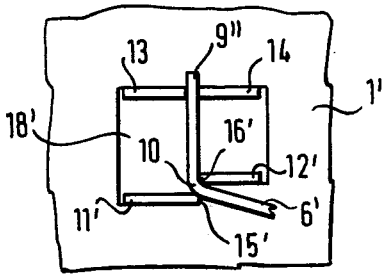
FIG. 4 shows a modified detail of the device of FIG. 1 on the scale of FIGS. 2 and 3.

The end portion of the spring 6' shown in FIG. 4 has a single bend 10 located between the two gaps of the paired lugs, but contiguously adjacent the lugs 11', 12'. The free end portion 9'' of the spring 6' which projects from the gap between the lugs 13, 14 is straight. As is not explicitly shown in FIG. 4 for the sake of clearer pictorial representation, the lug 11' projects toward the viewer beyond the spring 6' and is normally peened over the spring in the manner shown in FIG. 3.

Figure 2:
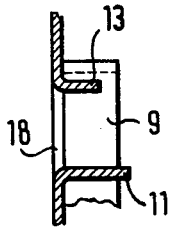
FIGS. 2 and 3 illustrate enlarged details of the device of FIG. 1 in respective sections on the lines II — II and III — III.

Longitudinal displacement of the spring 6' is prevented in the device of FIG. 4 by the single bend 10 as effectively as by the two bends 9', 10 shown in FIGS. 1 to 3, and preparation of the spring is thereby simplified. The non-illustrated stamping die needed to produce the modified carrier plate 1 is not significantly more complex than that employed in preparing the plate 1.

The spring-retaining lugs of the invention do not add weight to the window lifting mechanism. They do not occupy space that could be used for any other purpose. They do not require the formation of openings or other recesses in the fastened spring that could weaken the spring. They reduce the cost of making and assembling the mechanism without contributing compensating disadvantages.

In all illustrated embodiments, integral sheet metal lugs have been used for fastening an end of the spring 6, 6' to the normally stationary carrier plate 1, 1'. However, an equivalent lug arrangement may be employed for fastening an end portion of the spiral spring to the lever 4 or the segment 2 if the operating member is made of sheet material lending itself to the necessary shaping operation.

Sheet metal is the most economical material available at this time for a carrier or operating member provided with the integral lugs of this invention, but the invention is not limited to the specific material of construction. Glass-fiber reinforced epoxy resin may be given the necessary shape and would perform satisfactorily where desirable for reasons overriding the higher cost.

It should be understood, therefore, that the foregoing disclosure relates only to presently preferred embodiments of this invention, and that it is intended to cover all changes and modifications of the examples of the invention herein chosen for the purpose of the disclosure which do not constitute departures from the spirit and scope of the invention set forth in the appended claims.

What is claimed is:

1. A window lifting mechanism for a window comprising:

(a) a support including a carrier member;

(b) an operating member mounted on said support for angular movement about an axis, (1) one of said members essentially consisting of a unitary piece of material having a face transverse to said axis, (2) two pairs of integral lug portions of said piece being angularly offset from said face, the lug portions of each pair defining a gap therebetween;

(c) an elongated spiral spring having two longitudinal end portions and an intermediate portion connecting said end portions and extending about said axis, (1) one of said end portions having two longitudinally spaced parts respectively secured in said gaps in abutting engagement with the lug portions defining the respective gaps;

(2) said spring being formed with two bends, (3) each of said bends being contiguously adjacent an associated one of said gaps and longitudinally offset from the associated gap in a direction away from the other gap; and (d) fastening means fastening the other end portion of said spring to the other one of said members in a position for biasing said operating member to move angularly about said axis under the resiliency of said spring.

2. A mechanism as set forth in claim 1, wherein said two lug portions of each pair have two major opposite surfaces and a narrow edge connecting said surfaces, each gap being bounded by said narrow edges.

3. A window lifting mechanism for a window comprising:

(a) a support including a carrier member;

(b) an operating member mounted on said support for angular movement about an axis, (1) one of said members essentially consisting of a unitary piece of material having a face transverse to said axis, (2) two pairs of integral lug portions of said piece being angularly offset from said face, the lug portions of each pair defining a gap therebetween;

(c) an elongated spiral spring having two longitudinal end portions and an intermediate portion connecting said end portions and extending about said axis, (1) one of said end portions having two longitudinal spaced parts respectively secured in said gaps in abutting engagement with said lug portions defining the respective gaps.

(2) said one end portion being formed with a bend intermediate said two parts; and (d) fastening means fastening the other end portion of said spring to the other one of said members in a position for biasing said operating member to move angularly about said axis under the resiliency of said spring.

4. A mechanism as set forth in claim 3, wherein said lug portions each have two major opposite surfaces and a narrow edge connecting said surfaces, said gaps being bounded by the narrow edges of respective pairs of said lug portions, the major surfaces of the lug portions in one of said pairs extending substantially in common planes, the major surfaces of the lug portions in the other pair being transversely offset from each other.

5. A mechanism as set forth in claim 4, wherein said other pair is nearer said intermediate portion than said one pair.

6. A window lifting mechanism for a window comprising:

(a) a support including a carrier member;

(b) an operating member mounted on said support for angular movement about an axis, (1) one of said members essentially consisting of a unitary piece of material having a face transverse to said axis, (2) two integral lug portions of said piece being angularly offset from said face and defining a gap therebetween;

(c) an elongated, spiral leaf spring having two longitudinal end portions and an intermediate portion connecting said end portions and extending about said axis, (1) one of said end portions having a part secured in said gap in abutting engagement with said two lug portions, (2) the width of said leaf spring in the direction of said axis being greater than the thickness thereof transverse to said width, (3) the thickness of said part of said one end portion in the relaxed condition of said spring being greater than the width of said gap in the absence of said part; and (d) fastening means fastening the other end portion of said spring to the other one of said members in a position for biasing said operating member to move angularly about said axis under the resiliency of said spring.

7. A window lifting mechanism for a window comprising:

(a) a support including a carrier member;

(b) an operating member mounted on said support for angular movement about an axis, (1) one of said members essentially consisting of a unitary piece of material having a face transverse to said axis, (2) two integral lug portions of said piece being angularly offset from said face and defining a gap therebetween;

(c) an elongated spiral spring having two longitudinal end portions and an intermediate portion connecting said end portions and extending about said axis, (1) one of said end portions having a part secured in said gap in abutting engagement with said two lug portions;

(2) one of said lug portions projecting axially from said face beyond the secured part and carrying a projection axially aligned with said secured part, axial movement of said part being limited by said projection and said face; and (d) fastening means fastening the other end portion of said spring to the other one of said members in a positicn for biasing said operating member to move angularly about said axis under the resiliency of said spring.

8. A mechanism as set forth in claim 7, further comprising fastening means for fastening said carrier member to the body of a motor vehicle, said one member being said carrier member, and said material being metallic sheet.

* * * * *